United States Patent [19]

Hefele

[11] 4,204,017

[45] May 20, 1980

[54] RASTER-LIKE HEAT SEALABLE ADHESIVES ON SUBSTRATES

[75] Inventor: Josef Hefele, Gräfelfing, Fed. Rep. of Germany

[73] Assignee: Kufner Textilwerke KG, Fed. Rep. of Germany

[21] Appl. No.: 695,814

[22] Filed: Jun. 14, 1976

Related U.S. Application Data

[63] Continuation of Ser. No. 341,961, Mar. 16, 1973, abandoned.

[30] Foreign Application Priority Data

Mar. 23, 1972 [DE] Fed. Rep. of Germany ..... 2214236

[51] Int. Cl.[2] ..... B32B 3/12; B32B 3/26

[52] U.S. Cl. ..... 428/160; 428/198; 428/201; 428/212; 428/423.3; 428/424.2; 428/474

[58] Field of Search ..... 427/207; 428/261, 200, 428/198, 201, 212, 347–349, 425

[56] References Cited

U.S. PATENT DOCUMENTS

| | | | |
|---|---|---|---|
| 3,098,235 | 7/1963 | Gusman | 428/198 |
| 3,235,396 | 2/1966 | Haberlin | 117/6 |
| 3,446,658 | 5/1969 | Rose | 428/198 |
| 3,914,493 | 10/1975 | Graber et al. | 428/200 X |

FOREIGN PATENT DOCUMENTS 500178 2/1954 Canada .

*Primary Examiner*—Bernard D. Pianalto

*Attorney, Agent, or Firm*—Hill, Van Santen, Steadman, Chiara & Simpson

[57] ABSTRACT

A patch or insert, which may be applied to clothing or the like, consists of a substrate, which is preferably a textile fabric, on which is mounted a discontinuous pattern, in raster-like formation, of a heat sealing adhesive. The coating consists of two superposed layers of adhesive, each adhesive having a different adhesive quality.

7 Claims, 1 Drawing Figure

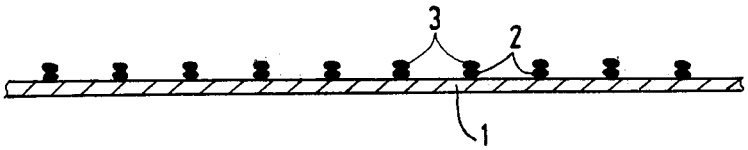
3
2
1

RASTER-LIKE HEAT SEALABLE ADHESIVES ON SUBSTRATES

This is a continuation, of application Ser. No. 341,961, filed Mar. 16, 1973 and now abandoned.

The present invention relates to a structure, which may be used as an insert, especially for stiffening, or as a patch or lining material for articles of clothing, and which comprises a substrate having a discontinuous coating of a heat-sealing adhesive.

Such structures are known, the discontinuous coating of adhesive generally being referred to as a "raster-like" coating. They have become of particular importance with so-called "front fixation," in which inserts based on knitted fabrics, woven materials or fleeces are heat-sealed, e.g. by ironing or hot pressing, onto cloths. In general, the heat-sealing adhesive is applied to the insert in a regular raster formation, preferably in a spot raster formation, so that the soft textile feel remains in the composite of the insert and the cloth.

It is important that the adhesive selected for use as the raster-like coating should be resistant to washing and dry cleaning. Also, it must have sufficient adhesive strength, even if, in order to protect the cloth onto which the insert is applied, relatively gentle sealing or fixing pressures and temperatures are used for comparatively short periods of time. Furthermore, the adhesive should not adversely affect the feel of the composite formed from the insert and the cloth.

In practice, it is impossible to avoid fluctuations in fixing and ironing conditions, and, in particular, it is difficult to avoid fluctuations in pressure, temperature, time, and the effect of steam. The adhesive chosen should be such that the effect of these fluctuations on the feel and adhesive value should be as little as possible. Finally, it is known that a large number of different types of cloth, which may differ in fibre thickness, type of fibre, yarn strength, yarn twist, thickness of weave, kind of weave, dye, finish, and nap, and which must be treated in the manufacture of ready-to-wear clothing should be capable of being processed under fixing or sealing conditions which are as nearly uniform as is possible.

However, these criteria are either not or only incompletely fulfilled by commercially available heat-sealing inserts. Although the most commonly used heat-sealing adhesives, which are based on polyamides, polyethylenes or polyvinyl chlorides (PVC), are resistant to water-washing and dry cleaning and although relatively gentle fixing conditions can be provided by reducing their melting temperature range and/or their melt viscosity, these adhesives are not sufficiently free from alterations in feel and adhesive values when applied under a wide range of processing conditions and they do not permit a large assortment of different types of cloth used for ready-to-wear clothing to be processed under uniform conditions.

It is an object of the invention to overcome the disadvantages of the known inserts and to provide a structure having a raster-like adhesive coating which maintains a uniform feel and adhesive value over a wide range of processing conditions and which permits a wide variety of different types of cloth to be adhered to the structure under uniform conditions.

This and other objects of the invention are achieved by providing a raster-like coating which consists of at least two superposed raster-like layers of different adhesive quality.

Thus, the present invention consists in a structure suitable for use as a patch, a lining or an insert and which comprises a substrate to which is directly applied a first raster-like layer of adhesive and which has a second raster-like layer of adhesive having a different adhesive quality from the adhesive of the first layer and attached to the first layer. In a particularly preferred embodiment of the invention, still further layers of adhesive of different adhesive quality are applied to the second layer. All layers of adhesive should have the same pattern.

The invention substantially extends the range of tolerance when heat-sealing the structures of the invention onto other materials, particularly cloths. Thus, the pressure, time, effect of steam, and temperature can all fluctuate widely without altering the feel of the composite and without the stability of the adhesive suffering. Moreover, the invention makes it possible to connect satisfactorily materials which are difficult to seal, e.g. siliconized cloths, to inserts with an adhesive stability which has not hitherto been achieved. Until now, when sealing such cloths, such high temperatures and pressures had to be applied that the adhesive penetrated the insert and the cloth. Such penetrations need no longer occur when using a coating according to the present invention.

The adhesive coating can not only be applied to woven materials, knitted fabrics, fleeces and foams, but also to natural and synthetic leathers, imitation skins, paper, tapestry, wood, and the like.

If desired, the coating may be applied to only certain specific areas of the substrate. Such a partial coating is of particular use, for example, in so-called multi-stage insert webs, where there are differences in weave thickness, type of weave, fibre strength, yarn thickness, or yarn count, in various longitudinal or transverse areas of the web. These differences lead to differences in the adhesive strength between the insert and the material to which it is applied, since the flow of heat occurs at different speeds during fixing in these different areas. These variations in adhesive strength are compensated for by the coating of the invention by providing at least two superposed layers of adhesive having different adhesive quality in specific areas of the web.

The pattern of the coating of the invention can be linear, grid-like or helical, and, although any desired pattern may be used, the pattern is most preferably regular. We particularly prefer to use a spot raster formation, particularly when the coating is applied to a substrate consisting of a knitted fabric, woven fabric, fleece or foam, and particularly when the substrate is to be joined to a textile material. The spot raster coating is particularly advantageous in the case of inserts and linings. An irregular pattern may be used.

The material properties of the layer of adhesive lying directly on the substrate are preferably such that, under the conditions in which heat-sealing adhesion is to be carried out, this adhesive has a lower thermoplastic flowability than the uppermost layer. This may be achieved, for example, by adjusting the melt viscosity and/or the melting point or temperature range in which the heat-sealing adhesive begins to melt.

In one preferred embodiment of the invention, in which the coating consists of only two layers of adhesive, the lower layer (lying directly on the substrate) preferably has a higher melt viscosity and/or higher melting point or higher melting range than the upper layer. Such a structure may, for example, be achieved by making the lower layer of a plastics material which is free from plasticizer or which has a low plasticizer content and by making the upper layer from a plastics material having a higher plasticizer content. Alternatively, the differences between the adhesive properties of the upper and lower layers can be produced by using polymers of different chemical make-up, copolymers in which the ratios of the monomers differ, or polymers having different degrees of polymerization.

Materials which are suitable for use as the lower layer include, for example, PVC having a low plasticizer content, low pressure polyethylene (which has a comparatively high melt viscosity) polyacrylates (which may or may not be cross-linkable) polyvinylalcohol, polyamides, and polyurethanes (which may or may not be cross-linkable). The upper layer may, for example, consist of PVC having a higher plasticizer content, low pressure polyethylene which has a lower melt viscosity, noncross-linkable polyacrylates, polyvinyl alcohol, or, most preferably, low melting point polyamides or polyurethanes, which may contain plasticizer.

An alternative method of producing a structure having a lower layer of low plasticizer content and an upper layer of high plasticizer content consists in applying a single coating of an adhesive to a substrate. Pure plasticizer, or a solution or emulsion of plastizicer, is then applied to this coating and allowed to diffuse partially into the coating. Since the plasticizer only diffuses into the upper part of the coating, the coating is effectively divided into two layers, the upper of which has a high plasticizer content, whilst the lower has little or no plasticizer. The adhesive qualities of the two layers are, therefore, different.

The accompanying drawing shows a diagrammatic cross-sectional view of a preferred embodiment of the invention.

In this drawing, a substrate 1, e.g. a lining material, supports a coating made up of a lower layer 2 and an upper layer 3.

The raster-like lower layer 2 can be produced in the usual way on a substrate using an engraving roller or a screen printing circular template, the adhesive, in the form of a powder or paste, being wiped into the raster engraving of the roller or into the perforated raster of the screen printing circular template and thence being applied to the substrate. After sintering the lower layer, the upper layer may be applied, a wiper roller or roller coater being particularly suitable for this purpose. Thus, a thin layer of a heat-sealing adhesive, which has been liquified by emulsifying or suspending with a solvent in an aqueous medium or even by the action of temperature, or a thin layer of a plasticizer, plasticizer solution or plasticizer emulsion is applied to a smooth roller and this layer is partially transferred by light pressure from the roller onto the top of the raster-like pattern of the lower layer. After passing beneath the rotating roller, the coated substrate is then dried, if required. In exceptional cases, an intermediate layer may be necessary between the upper and lower layers, for example an adhesive agent may be required between the two layers.

The invention is further illustrated with reference to the following Examples, which show preferred embodiments of the invention which are in no way limiting.

EXAMPLE 1

An insert fabric was coated with an 11 mesh raster (equal to 121 spots per square inch) of a 6,6/6,12-copolyamide powder (melting point measured on the Kofler hot block about 120° C., melt viscosity at 160° C. about 20,000 poise) in an amount of 18 g/m$^2$, by the powder spot method using a puntiform engraved roller. After sintering the spots, the coated fabric was passed beneath a rotating wiper roller, so that the coated spots abutted against the roller. A thin layer of an adhesive solution was wiped using a doctor blade onto the smooth roller wall and thence was applied to the spots on the coated fabric. The solution consisted of 50 parts by weight of the same copolyamide as was used in the lower layer, 50 parts by weight of a plasticizer, 70 parts by weight of trichloroethylene and 30 parts by weight of methyl alcohol. The coating was then dried and, after drying, the weight of the coating was 30 g/m$^2$.

The coarser spot rasters frequently used with linings for outer clothing and having from 94 to 260 spots per square inch (corresponding to a 9–15 mesh raster) can easily be prepared using a wiper roller or roller coater; however, a higher wiper and roller accuracy is necessary if the finer spot rasters, which are also in use, are to be manufactured.

However, even in the case of a very fine raster, the coating of the invention can be produced without any problem, by forming the lower layer, in a raster-like formation, from a viscous and pasty plastics material or resin and then dispersing a powdery or flake-like heat-sealing adhesive or plasticizer for this adhesive into the lower layer. Alternatively, the coating may be produced by applying a heat-sealing network formed by stamping from a two-layered composite foil or by applying two superposed layers of intersecting groups of threads, in which the layers are of different kinds of adhesive.

During dispersion, the powder or flake is secured in the viscous paste forming the lower layer. The excess powder or flake not secured is sucked off, blown off and/or shaken off. The raster-like coating which remains is then made up of superposed layers of adhesives having different adhesive properties and, after drying, gelling and/or sintering, which may be necessary, the coating has the required variation in flow properties during heat-sealing.

The powdery or flake-like heat-sealing adhesive or plasticizer used should be relatively fine and, in the case of a powder, should have a particle size less than 100 microns. For front fixation in the manufacture of outer clothing which is resistant to dry cleaning, we prefer to use powdery or flake-like heat-sealing adhesives based on copolyamides which have a melting point below about 125° C. preferably below about 118° C., and a melt viscosity below about 20,000 poise, and preferably below about 5,000 poise, at 160° C. Such products, which are commercially available as powder, are mostly in the form of ternary or quaternary polyamides manufactured from lactams, acid amides, carboxylic acids and diamines using chain breakers. Such copolyamides can be processed into fibres and ground or cut up into flakes and can be used in the present invention in the form of ground or cut flakes.

In addition, it is possible to use flakes made of polyurethanes, polyethylenes or PVC. Similarly, commercial PVA powders are suitable for use where resistance to dry cleaning is not required.

Finally, it is also possible to disperse powdery plasticizers into the lower layer in place of the heat-sealing adhesive powders. Thus, for example, a powdery sulphonic acid amide or a resin-like condensation product thereof, can be dispersed into a coating of a copolyamide and, during drying and sintering, the plasticizer will partially diffuse into the coating and will lower the melting range and the melt viscosity of an upper layer of the coating. In the case of a coating of PVC, powdered dicyclohexylphthalate can be used as the plasticizer.

Many variations are possible in the chemical nature of the plastics-containing viscous paste lower layer, which is applied in a raster-like formation. We particularly prefer to use mixtures which have been manufactured by stirring a plastics powder into an aqueous dispersing agent, or a commercially available plastics dispersion, which may be thickened. Thus, for example, one may use aqueous pasty mixtures of polyamides, polyurethanes or low pressure polyethylene, or dispersions based on PVC, PVA, polyacrylates or copolymers thereof, if, in the dried state and under the sealing conditions, they have a lower thermoplastic flowability than the dispersed plastics powder.

In place of these aqueous pasty mixtures, mixtures of plastics powders with plasticizers can be used, e.g. PVC powder in admixture with relatively low quantities of a polymer plasticizer. One can also use viscous solutions of plastics in organic solvents, such as solutions of polyurethanes or their reaction mixtures.

In all of these cases, it should be noted that the differences in flow properties remain preserved under the sealing conditions. These differences can easily be controlled by suitable selection of materials for the lower layer which, in the dried state, have a higher melt viscosity and/or a higher melting point range than the dispersed plastics powder.

In producing a structure according to the invention by this method, the lower layer can be produced in the usual way on a length of cloth using an engraving roller or a screen printing circular template, the adhesive being wiped as a paste into the wiper engraving of the roller or in the perforated raster of the screen printing template and thence being transferred to the substrate. The plastics powder or flake is then dispersed into the still pasty adhesive lower layer using a conventional dispersing assembly, such as is commonly used in flake or dispersion coating. The coating can be assisted using an electrostatic field which charges the flake or powder and propels it to the lower layer. Furthermore, a beater mechanism, which beats against the underside of the web-like substrate during the dispersion coating can be used and this likewise causes an improvement in the anchorage. In the case of coating with a flake, the flake is rendered parallel. Excess flake or powder lying between the raster is then removed by suction, beating and/or blowing. The substrate then passes through a heating, drying or gelling process in which the lower layer dries and sinters with the dispersed powder or flake without losing the structure of the coating and the differences in the thermoplastic flow. In order to facilitate the pressing process with the application of the lower layer and in addition to obtain additional security during fixing, known additives, such as fatty acids, can be added to the viscous pasty substance of the lower layer.

Polyamides, polyethylenes, PVC or polyurethanes can be used for the upper and lower layers. However, we particularly prefer that the lower layer should be a foil or group of threads of polyethylene and that the upper layer should be a group of threads of copolyamides, which may contain plasticizers. The polyethylenes should have a melting point of about 125° to 135° C. and a melt viscosity at 160° C. of about 10,000 to 40,000 poise. In order to increase the adhesion to the upper layer, the polyethylenes may be copolymers or may be modified by the incorporation of copolymers, e.g. of ethylene and vinyl acetate or saponification products thereof.

Particularly suitable copolyamides are those having a melting point below about 125° C., preferably below about 115° C., as measured on the Kofler hot block, and a melt viscosity below 20,000 poise, preferably below 5,000 poise, measured at 160° C. Products of this kind, which are commercially available, are mostly in the form of ternary or quaternary polyamides which are manufactured from lactams, acid amides, dicarboxylic acids and/or diamines with the use of chain breakers.

When using pure polyethylenes, it is best to increase the adhesion between these and the copolyamides in the usual manner by means of a corona discharge.

Stiffening inserts or linings may be coated with the heat-sealing adhesive networks used in the present invention in the same way as are conventional heat-sealing adhesive networks. Thus, the heated textile web is connected to the cold web-like adhesive network by the application of slight pressure in a conventional bonding mechanism, so that the layer of the network which melts or is viscous at a higher temperature comes into contact with the textile web. By appropriate control of temperature and through the application of slight pressure, the thick parts of the raster-like net first anchor themselves and the webs then break up and flow together to the thick parts. When using a network made of polyethylene or a copolymerized modification thereof as the lower layer and using a copolyamide as the upper layer, the polyethylene side is brought into contact with the textile web. After manufacture of the coating, the raster-like coating consists almost exclusively of a raster-like lower layer of polyethylene, with the copolyamide layer seated on the raster.

The following Examples illustrate the production of a raster-like coating by dispersion of a heat-sealing adhesive plasticizer.

EXAMPLE 2

Using the screen printing method, an insert fabric web was coated in a 17 mesh raster (equal to 350 spots per square inch) with a pasty mixture of 58 parts by weight of a 1.4% solution of ammonium polyacrylate, 4 parts by weight of finely divided stearic acid, and 38 parts by weight of a 6/6,6/12-copolyamide powder having a particle size less than 100 microns, a melting point on the Kofler hot block of about 120° C. and a melt viscosity at 160° C. of about 20,000 poise. The weight of the wet paste applied was about 40 g/m$^2$. Sufficient 6/6,11/12-copolyamide powder having a melting point on the Kofler hot block of 100° C. and a melt viscosity at 160° C. of 900 poise was dispersed into the wet layer, with the aid of a beater mechanism rotating beneath the fabric web, so that, after suction, beating and shaking off of the excess powder, 10 g/m$^2$ were dispersed. The fabric web was then dried and sintered and the weight of the coating applied amounted to about 26 g/m$^2$.

EXAMPLE 3

An insert fabric web was coated in a 17 mesh raster (equal to 350 spots per square inch) using the screen printing method, with a pasty mixture of 58 parts by weight of a 1.4% solution of ammonium polyacrylate, 4 parts by weight of finely ground stearic acid, and 38 parts by weight of a 6/6,6/12-copolyamide powder having a particle size less than 100 microns, a melting point on the Kofler hot block of about 120° C., and a melt viscosity at 160° C. of about 20,000 poise. The amount of wet paste applied was about 50 g/m$^2$. Sufficient plasticizer powder, in the form of a commercial mixture of ortho and para toluene sulphonic acid amides having a particle size less than 70 microns was dispersed into the damp layer, with the aid of a beater mechanism rotating beneath the fabric web, that, after suction, beating and shaking off the unattached excess powder, 6 g/m$^2$ had been dispersed. After drying and sintering the fabric web, the amount of coating applied was about 26 g/m$^2$.

EXAMPLE 4

100 parts by weight of a 20% solution in trichloroethylene of a commercial isocyanate-lengthened polyester having free hydroxyl groups and no free isocyanate groups were mixed with 5 parts by weight of a commercial 75% solution of a triisocyanate in ethyl acetate and 5 parts by weight of a commercial 10% catalyst solution in an ethyl acetate/ethyl chloride mixture. The viscous mixture was applied to an insert fabric web in an 11 mesh raster (equal to 140 spots per square inch) using the screen printing method. Whilst the raster coating was not yet dry, melted fibre flake of a 6/6,6/12-copolyamide having a melting point on the Kofler hot block of about 120° C., a melt viscosity at 160° C. of about 20,000 poise, a fibre thickness of 3.0 denier, and a fibre length of about 1.0 mm, was dispersed over the coating, with the aid of a beater mechanism and an electrostatic field. After drying and removing excess flake, the total weight applied was about 20 g/m$^2$, of which the melted fibre amounted to about 10 g/m$^2$.

I claim:

1. A flexible adhesive clothing insert structure adapted for being heat sealed with another flexible clothing structure, comprising:

(a) a flexible clothing insert;

(b) a first raster-like layer of a heat sealable adhesive coated directly on one side of said flexible clothing insert;

(c) a second raster-like layer of a heat sealable adhesive seated substantially only on said first raster-like layer, said second raster-like layer having adhesive properties different than said first layer and a melting point lower than said first layer; and (d) said first and second raster-like layers are of spot raster form and having at least 94 spots per square inch, isolated spots of said second layer being seated substantially only upon spots of said first layer;

whereby said flexible clothing insert retains its flexibility after heat sealing to flexible clothing structure and said heat sealable adhesive spots of the second layer are isolated from the substrate clothing insert by the spots of the first layer.

2. A structure as claimed in claim 1, wherein said first layer is attached directly to said clothing insert and has lower thermoplastic flow properties than said second layer.

3. A structure as claimed in claim 1, wherein said first and second layers are of plastics materials containing a plasticizer, said second layer having a higher plasticizer content than said first layer.

4. A structure as claimed in claim 1, wherein said first and second layers are of plastics material, and only said second layer contains a plasticizer.

5. A structure as claimed in claim 1, wherein said second layer consists essentially of a low melting point plastics material selected from the group consisting of polyamides and polyurethanes.

6. A structure as claimed in claim 1, wherein said clothing insert is a fabric selected from the group consisting of knitted fabrics, woven fabrics and fleeces.

7. A structure as claimed in claim 1, wherein said clothing insert is a foam.

* * * * *